US009233264B2

(12) United States Patent
Graham et al.

(10) Patent No.: US 9,233,264 B2
(45) Date of Patent: Jan. 12, 2016

(54) FIRE SUPPRESSION SYSTEM FOR AIRCRAFT STORAGE CONTAINERS

(71) Applicants: Roger William Graham, Louisville, KY (US); Joe Jarles, Prospect, KY (US); Doug Phelps, Collinsville, OK (US); Todd Joseph Kerger, Prospect, KY (US)

(72) Inventors: Roger William Graham, Louisville, KY (US); Joe Jarles, Prospect, KY (US); Doug Phelps, Collinsville, OK (US); Todd Joseph Kerger, Prospect, KY (US)

(73) Assignee: Fire Flighters LLC

( * ) Notice: Subject to any disclaimer, the term of this patent is extended or adjusted under 35 U.S.C. 154(b) by 85 days.

(21) Appl. No.: 13/974,101

(22) Filed: Aug. 23, 2013

(65) Prior Publication Data

US 2015/0053431 A1 Feb. 26, 2015

(51) Int. Cl.

| | |
|---|---|
| ***A62C 35/02*** | (2006.01) |
| ***A62C 35/08*** | (2006.01) |
| ***A62C 3/08*** | (2006.01) |
| ***A62C 13/78*** | (2006.01) |
| ***A62C 37/08*** | (2006.01) |
| *A62C 3/00* | (2006.01) |
| *A62C 37/50* | (2006.01) |

(52) U.S. Cl.

CPC . *A62C 3/08* (2013.01); *A62C 13/78* (2013.01); *A62C 37/08* (2013.01); *A62C 3/002* (2013.01); *A62C 37/50* (2013.01)

(58) Field of Classification Search

CPC ..... A62C 13/00; A62C 13/003; A62C 35/02; A62C 35/023; A62C 31/05; A62C 3/08; A62C 35/05; A62C 35/08

USPC ..... 169/30, 60, 61, 67, 68, 70, 72, 74, 71, 169/53; 244/129.2

See application file for complete search history.

(56) References Cited

U.S. PATENT DOCUMENTS

| | | | | |
|---|---|---|---|---|
| 5,742,037 | A * | 4/1998 | Scola et al. | 235/454 |
| 6,104,301 | A * | 8/2000 | Golden | 340/628 |
| 7,806,195 | B2 * | 10/2010 | Popp et al. | 169/16 |
| 8,613,325 | B2 * | 12/2013 | Guse | 169/44 |
| 8,651,194 | B2 * | 2/2014 | Yoshida | 169/72 |

* cited by examiner

*Primary Examiner* — Arthur O Hall
*Assistant Examiner* — Joseph A Greenlund
(74) *Attorney, Agent, or Firm* — H. Jay Spiegel

(57) ABSTRACT

A fire suppression system for aircraft storage containers includes a fire suppression unit removably located within each cargo container and a human to machine interface (HMI) located in the aircraft cockpit. Each fire suppression unit includes an identifier so that each unit is identified and correlated with its container. The HMI monitors each fire suppression unit including monitoring internal temperature, presence of chemical fumes, presence of smoke, presence of flammable gases, and presence of fire. Each fire suppression unit is programmed with specific thresholds of temperature, chemical fumes, smoke, and/or flammable gases, whereby when a threshold is reached activation of fire suppression means within the fire suppression unit is accomplished.

20 Claims, 11 Drawing Sheets

HMI Unit Flow Chart
(Human to Machine Interface)

XPAC Unit Flow Chart

FIRE SUPPRESSION SYSTEM FOR AIRCRAFT STORAGE CONTAINERS

BACKGROUND OF THE INVENTION

The present invention relates to a fire suppression system for aircraft storage containers. Fire suppression systems used in aircraft are generally well known. However, Applicants are unaware of any such system specifically designed to be removably placed within cargo containers in the baggage compartment of an aircraft and including means for sensing adverse conditions and also including means for communicating in the cockpit of the aircraft so that pilots and other crew can monitor the conditions within storage containers stored within the baggage compartment of an aircraft.

In a flying aircraft, a fire or conditions leading to initiation of a fire can easily be fatal to the aircraft's continuing ability to safely fly. On Jul. 12, 2013, an Ethiopian Airlines Boeing 787 aircraft caught fire while sitting on the tarmac at London's Heathrow Airport. Earlier, on Jan. 7, 2013, a fire broke out aboard an empty Japan Airlines Boeing 787 Dreamliner at Boston's Logan Airport. The cause of that fire was a defective battery. Luckily, both of these incidents occurred when the aircraft were on the ground.

The passengers and crew of ValuJet flight 592 were not so lucky when, on May 11, 1996, their DC-9 aircraft caught fire and crashed in the Florida Everglades. It was later found that the fire was caused by a number of chemical oxygen generators that were improperly stored in the baggage compartment. After this incident, the National Transportation Safety Board (NTSB) recommended to the Federal Aviation Administration (FAA) that all Class D cargo holds have smoke detectors and/or fire suppression systems. While such systems are now installed in the cargo holds of aircraft, the problem is that a fire is rarely started in the cargo hold. Rather, if a fire is going to start, typically, it starts within large cargo containers that are loaded into the aircraft cargo hold. Punctuating the need for improved fire suppression systems in aircraft cargo containers, UPS Flight 6 out of Dubai, a 747-400 cargo plane, crashed on Sep. 3, 2010 near Dubai International Airport after a load of batteries in a cargo container caught fire.

To maximize the ability of an aircraft to store baggage and other items, typically, cargo containers are designed so that their outer walls mimic the shape of the cargo hold so that such storage containers can be easily loaded and unloaded and provide the maximum volume of storage of items within the cargo hold. Doors accessing the cargo hold are specifically sized and configured to allow easy placement of these cargo containers within the cargo hold and easy removal therefrom so that these containers can be loaded and unloaded. A blueprint of the cargo hold of an aircraft easily shows that each cargo container is designed to be located in a specific location within the cargo hold due to the unique outer configuration of each cargo container mimicking the configuration of the location within the cargo hold where that specific container is to be located. As such, it is possible to numerically identify each cargo container with specificity. It would be advantageous to devise a system in which a portable fire detection and suppression system could be placed within each cargo container and each such system could be specifically identified with each such system communicating with the cockpit of an aircraft so that the pilots and other crew could closely monitor ambient conditions within the cargo hold of an aircraft and ensure rapid response to any adverse conditions. It is with these thoughts in mind that the present invention was developed.

Applicants are aware of the following prior art:

U.S. Pat. No. 8,200,379 to Manfredi et al, discloses sensors for detecting conditions aboard an aircraft or inside various compartments of the aircraft. Included in these conditions are fire and smoke. The system includes means for notifying pilots or crew members of an adverse condition.

U.S. Pat. No. 8,035,520 to Hanania discloses a discrete intelligence system which includes the ability to sense when a cargo crate has been opened in an unauthorized fashion. Hanania also discloses that such a sensor can be used on canisters or other containers to detect temperature changes.

U.S. Pat. No. 7,142,105 to Chen discloses a fire alarm algorithm using smoke and gas sensors that may be located in the compartments of an aircraft.

U.S. Pat. No. 6,960,987 to Dohi et al. discloses a fire alarm system, fire sensor, fire receiver, and repeater and contemplate use of a plurality of sensors which when triggered identify location, including the use of a transmitter and receiver.

U.S. Pat. No. 5,347,274 to Hassett discloses a system in which a plurality of sensors are mounted on a vehicle to monitor characteristics including temperature and to wirelessly communicate those conditions.

U.S. Published Application No. US 2007/0241879 to Jobe et al. discloses wireless interconnection between components of a fire and security protection system and a control panel, controller and/or computer network.

U.S. Published Application No. US 2005/0128093 to Genova et al. discloses a self-protected fire sensing alarm apparatus and method that contemplates use in an aircraft seating area as well as the use of a remote monitor.

The present invention differs from the teachings of these references as contemplating an integrated system including locating discrete fire sensing and suppression systems in cargo containers located within the cargo compartment of an aircraft and wireless communication between those systems and a human to machine interface located in the cockpit of that aircraft.

SUMMARY OF THE INVENTION

The present invention relates to a fire suppression system for aircraft storage containers. The present invention includes the following interrelated objects, aspects and features:

(1) In a first aspect, the present invention consists of two types of intelligent interactive components, a fire suppression unit designed to be removably located within a cargo container stored in the cargo compartment of an aircraft, and a human to machine interface (HMI) preferably consisting of a touch screen monitor and display located in the aircraft cockpit. The fire suppression unit actually consists of a multiplicity of such units, one for each cargo container located within the cargo compartment of the aircraft.

(2) Each fire suppression unit includes a casing which is non-rectangular and non-square, for example, pentagonal. It is provided in that shape so that it can be easily distinguished by baggage handlers from the usual luggage and shipping boxes which are typically square or rectangular cubic as well as perhaps circular or spherical. The non-rectangular shape also prevents holes in its casing from being blocked by other cargo. Those holes facilitate the device sensing ambient conditions in a cargo container and provide exit points for fire suppressing chemicals. A barcode label or other identifier is adhered on the outer surface of the containment for the fire suppression unit so that the unit may easily be identified and to best facilitate programming the HMI to be able to recognize each unit as well as its location.

(3) As cargo containers are located into an aircraft with fire suppression units located therein, the HMI will automatically register and assign an ID number to each cargo container correlated with the barcode on its contained fire suppression unit so that the HMI within the aircraft cockpit can correlate the fire suppression unit to the cargo container in which it is contained so that the pilot or other aircraft personnel can be sure which fire suppression unit is located within which cargo container to facilitate monitoring the conditions within the respective cargo containers.

(4) The HMI is capable of monitoring each fire suppression unit and includes a touch screen display for this purpose. By manipulating the touch screen display, aircraft personnel within the cockpit may access each fire suppression unit and thereby monitor the current status of the interior of each cargo container. Among the information the HMI can collect and store from each fire suppression unit are such criteria as internal temperature, presence of chemical fumes, presence of smoke, presence of flammable gases, and presence of fire.

(5) If desired, each fire suppression unit may be programmed to periodically forward to the HMI through wireless transmission and reception the current conditions within each cargo container. Each fire suppression unit is programmed with specific thresholds of temperature, chemical fumes, smoke, and/or flammable gases, whereby when a threshold is reached activation of fire suppression means within the fire suppression unit is accomplished. If desired, an advance warning can be sent to the HMI prior to such activation, however, after a predetermined time period, whether or not communications are received by the fire suppression unit from aircraft personnel, the fire suppression unit is fully capable of independently actuating to suppress any fire condition detected within the cargo container. The same operations are equally accomplished by each and every fire suppression unit located within each and every cargo container within the cargo compartment of the aircraft.

(6) The hardware within each fire suppression unit may include the following:

a) A pressurized bottle containing an amount of clean fire suppression chemical sufficient to fill the entire volume of the internal space of the cargo container when empty, thereby facilitating extinguishment of any fire that may occur within the container. The bottle may, if desired, contain sufficient chemicals to permit suppression of more than one fire in a single cargo compartment during a single flight.

b) Additionally, the fire suppression unit may include smoke and chemical detectors, temperature sensors, and optical and ionization chamber sensors. A rechargeable battery is contained within the unit to run all systems and a microcontroller based PCV may monitor all functions and sensors.

c) An RF receiver is located within the unit facilitating communications back and forth with the HMI. If desired, a receptacle may be located accessible from outside the fire suppression unit housing to allow plugging in of a power source to facilitate recharging the battery.

Accordingly, it is a first object of the present invention to provide a fire suppression system for aircraft storage containers.

It is a further object of the present invention to provide such a system which includes a human to machine interface located in the aircraft cockpit and communicating with fire suppression units located within cargo containers in the cargo compartment of the aircraft.

It is a yet further object of the present invention to provide such a system in which each fire suppression unit includes an identifier allowing it to be correlated with the cargo container within which it is contained.

It is a still further object of the present invention to provide such a system in which each fire suppression unit includes the ability to sense the presence of smoke, fire, poisonous gases or temperature increase and to dispense a fire suppression chemical upon sensing of conditions leading to the conclusion that a fire is underway within the cargo container.

It is a yet further object of the present invention to provide such a system in which aircraft personnel within the cockpit of the aircraft can closely monitor conditions within each cargo container and selectively communicate with each fire suppression unit as necessary and desired.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
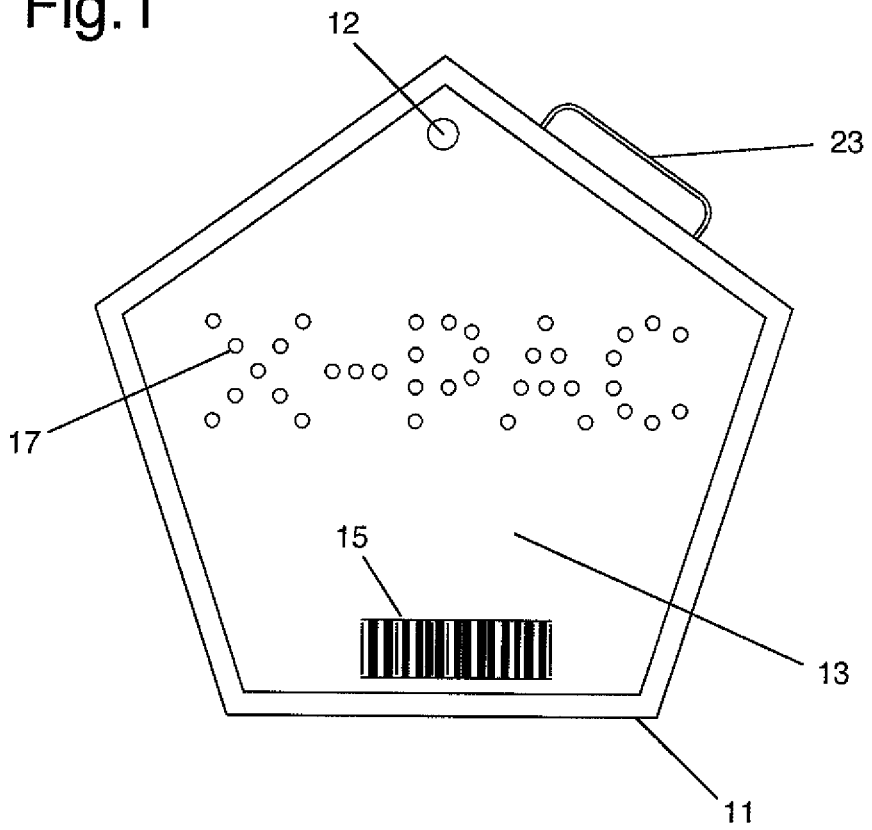
FIG. 1 shows a front view of a fire suppression unit in accordance with the teachings of the present invention.
Figure 2:
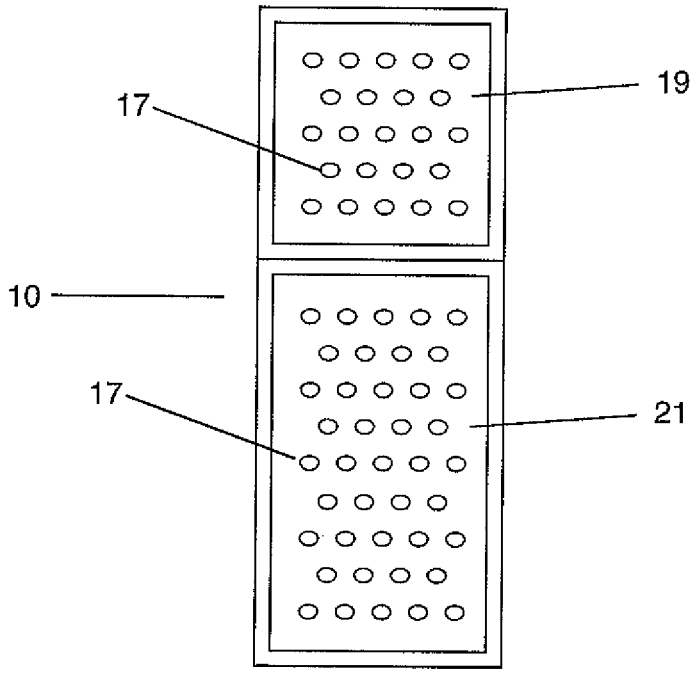
FIG. 2 shows a side view of the fire suppression unit.
Figure 3:
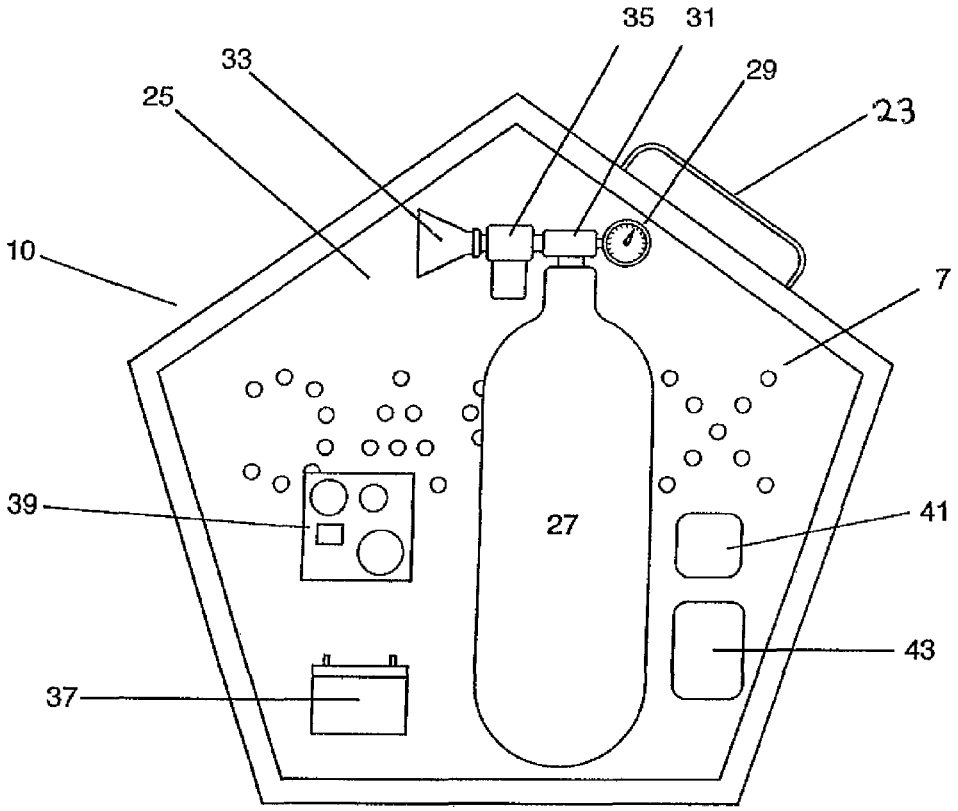
FIG. 3 shows a further front view with the front wall removed to show internal details.

Reference is first made to FIGS. 1-3 in which a fire suppression unit is generally designated by the reference numeral 10 and includes a housing 11 designed, in one example, to be pentagonal in shape. The housing is pentagonal in shape because typical baggage is rectangular cubic or spherical and the pentagonal shape of the fire suppression unit 10 enables baggage handlers to easily distinguish it from other baggage that will be loaded into cargo containers. The non-rectangular shape also prevents holes in its casing from being blocked by other cargo. Those holes facilitate the device sensing ambient conditions in a cargo container and provide exit points for fire suppressing chemicals.

The fire suppression unit shown in FIGS. 1-3 includes a front face 13 on which is located an identifier 15 such as a barcode label (FIG. 1). The barcode label is used by baggage handlers to allow identification of the unit 10 and correlation of the particular unit 10 bearing the barcode 15 with the particular barcoding thereon with the particular cargo container in which it will be placed. Also shown in FIG. 1 is a series of holes 17. With reference to FIG. 2, additional holes 17 are shown on a side wall 19 and another side wall 21 of the unit 10. These holes 17 are provided to allow the atmosphere within the cargo container to enter the inside of the unit 10 so that its sensing mechanisms can sense the ambient conditions. Additionally, the holes 17 permit fire suppression chemicals to be emitted from inside the unit 10 to suppress and eliminate a fire condition within the cargo container. Additionally, with reference to FIG. 1, a carrying handle 23 may be provided to allow easy transport of the fire suppression unit 10.

With reference to FIG. 3, the fire suppression unit 10 includes an inner chamber 25 in which several components are provided. A fire extinguisher 27 includes a gauge 29 allowing verification that the fire extinguisher 27 has its internal chamber pressurized with fire suppressing chemicals to the desired degree. A valve 31 controls flow of fire suppressing chemicals from within the fire extinguisher 27 out via the nozzle 33. The reference numeral 35 is directed to the actuator for the valve 31 which is controlled responsive to sensing of ambient conditions.

With further reference to FIG. 3, a battery 37 supplies power to the various components within the fire suppression unit 10. Those components include a communication unit or communications device 39 that includes an internal transmitter allowing wireless communications between the unit 10 and a human to machine interface (HMI) located in the cockpit of the aircraft. A temperature sensor 41 and a smoke detector 43 are contained within the chamber 25 and additional sensors such as those sensing chemical fumes and fire may also be included. The sensors 41 and 43 are connected to the communications device 39 either wirelessly or through the use of electrical conductors. The device 39 also incorporates a controller that senses conditions from the various sensors and responsive to sensing conditions exceeding a preset threshold activates the valve actuator 35 to open the valve 31 and permit dispensing of fire suppression chemicals from the fire extinguisher 27.

Figure 4A:
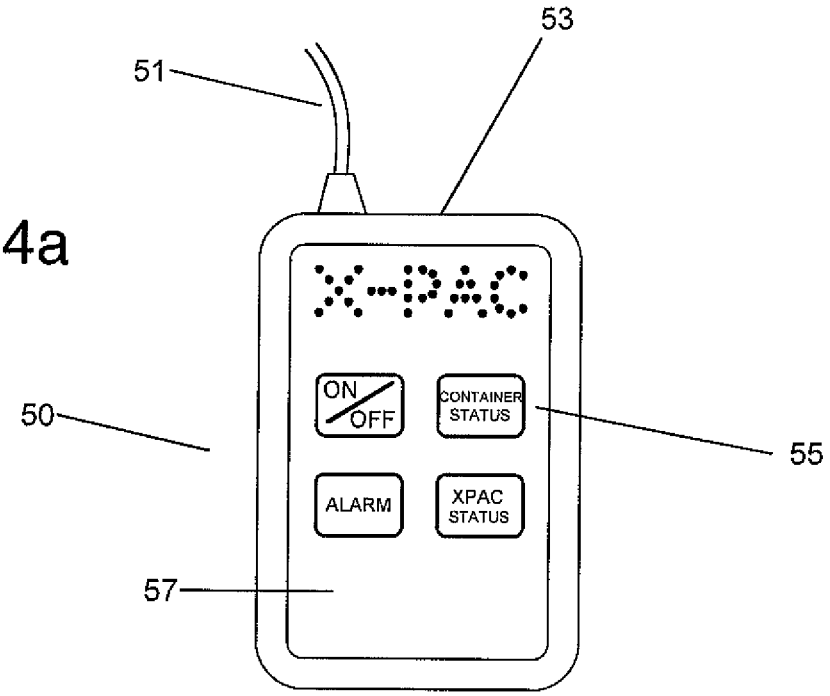
FIG. 4*a* shows a front view of the human to machine interface (HMI) mounted within the cockpit of the aircraft.

With reference now to FIGS. 4*a*-4*d*, the HMI 50 includes a conductor 51 that is connected to a source of power, a housing 53, and a touch screen display 55 that has numerous areas thereon that permit operation of the system. One such screen display 57 is shown in FIG. 4*a* and consists of the default screen display because it includes the on-off button. When that button is pushed, the system is activated. Pushing the container status button allows access to the screen display 59 shown in FIG. 4*b*. That screen display includes, for example, buttons numbered 1-12. Each such button when pushed on the touch screen display allows the user to gain access to a particular screen that is for each particular fire suppression unit. Thus, with reference to FIGS. 4*b* and 4*c*, when the user pushes the button numbered "1" on the screen display 59, the screen display changes to the screen display 61 shown in FIG. 4*c*. Each of the boxes shown on the display 61 provides information to the user concerning the criteria sensed by the fire suppression unit 10. Thus, the criteria of temperature, fumes, smoke and gases as well as fire may be indicated. The indications may include use of colored lights, for example, green for a normal condition and red for an abnormal condition or, alternatively, each box can display numerical data such as a temperature in Fahrenheit or Centigrade, the concentration of fumes, smoke and gases in parts per million, and indication of the existence of fire in some objective way. The button labeled COMF when pushed allows communications between the HMI and a particular container. For example, that button when pushed can transform the display to the display 63 shown in FIG. 4*d* in which the automatic nature of activation of the fire extinguisher 27 can be manually overridden by the operator in the cockpit.

Going back to FIG. 4*a*, the alarm button shown on the display 57 may indicate a situation in which a fire extinguisher 27 in one of the fire suppression units 10 has been activated and the indication can include the number of the unit activated as well as identifying information concerning the particular container implicated. When such an indication occurs, it may be appropriate for the operator to manually activate fire suppression units in containers adjacent the implicated container to prevent spread of a fire as desired.

Figure 5:
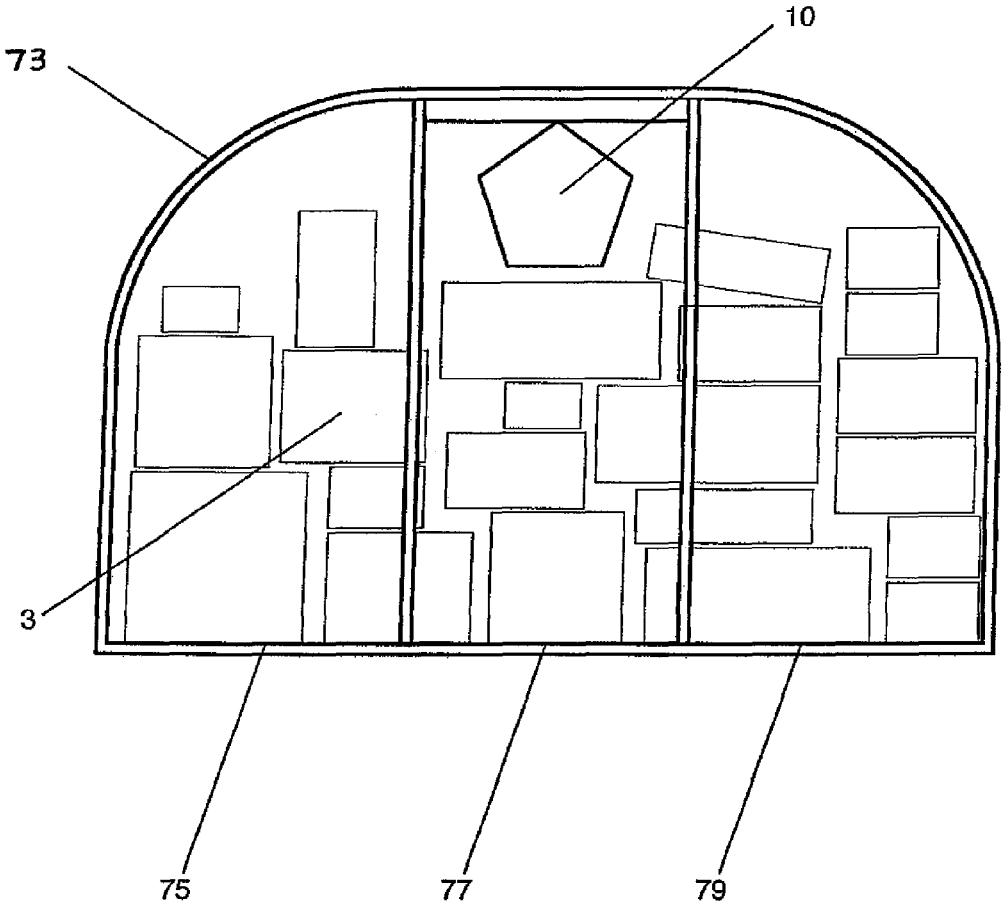
FIG. 5 shows a cross-section through an aircraft showing the preferred location of a fire suppression unit within a cargo container.
Figure 6:
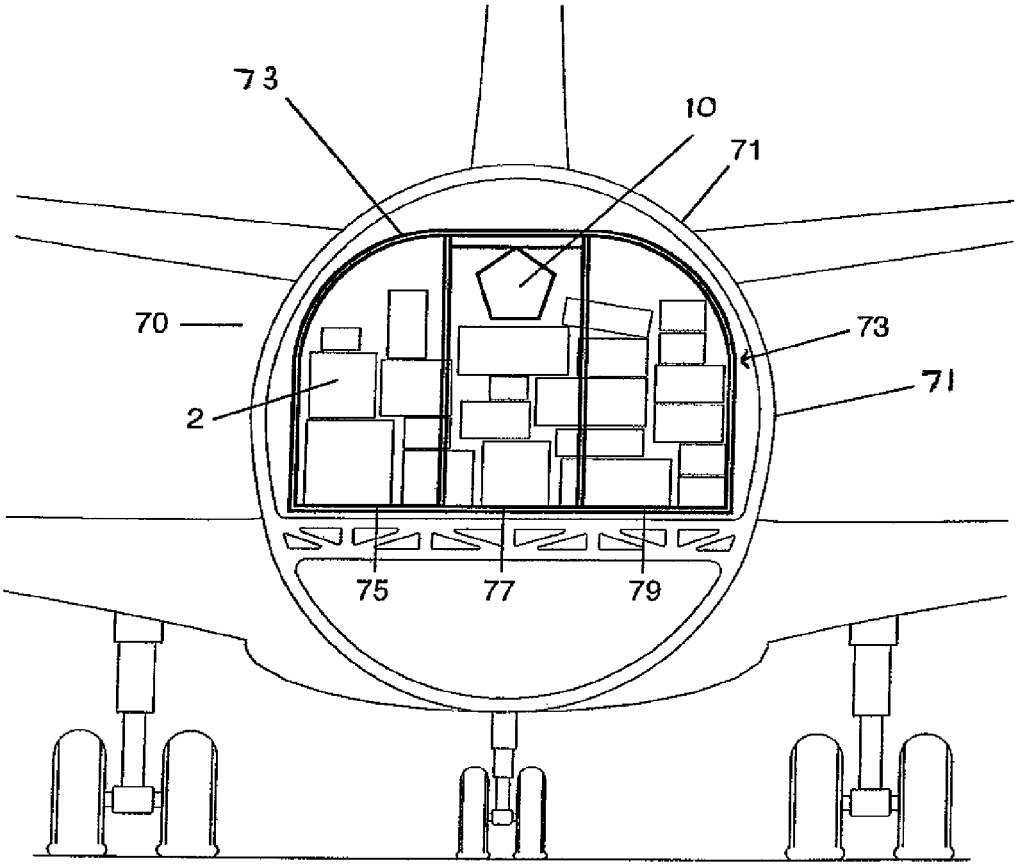
FIG. 6 shows a view similar to that of FIG. 5, but showing more of the aircraft structure.

With reference to FIGS. 5 and 6, an aircraft (FIG. 6) is generally designated by the reference numeral 70 and is seen to include a fuselage 71 having a baggage compartment 73 in which a plurality of cargo containers 75, 77 and 79 are located containing packages 2, 3. With particular reference to FIG. 5, the cargo container 77 is seen to have contained therein a fire suppression unit 10. The fire suppression unit 10 is shown placed at the upper extent of the cargo container 77. This placement is important because, typically, gases and fumes resulting from a fire condition are lighter than air and rise. Positioning the unit 10 at the uppermost portion of the container 77 best facilitates sensing of such conditions.

Figure 7:
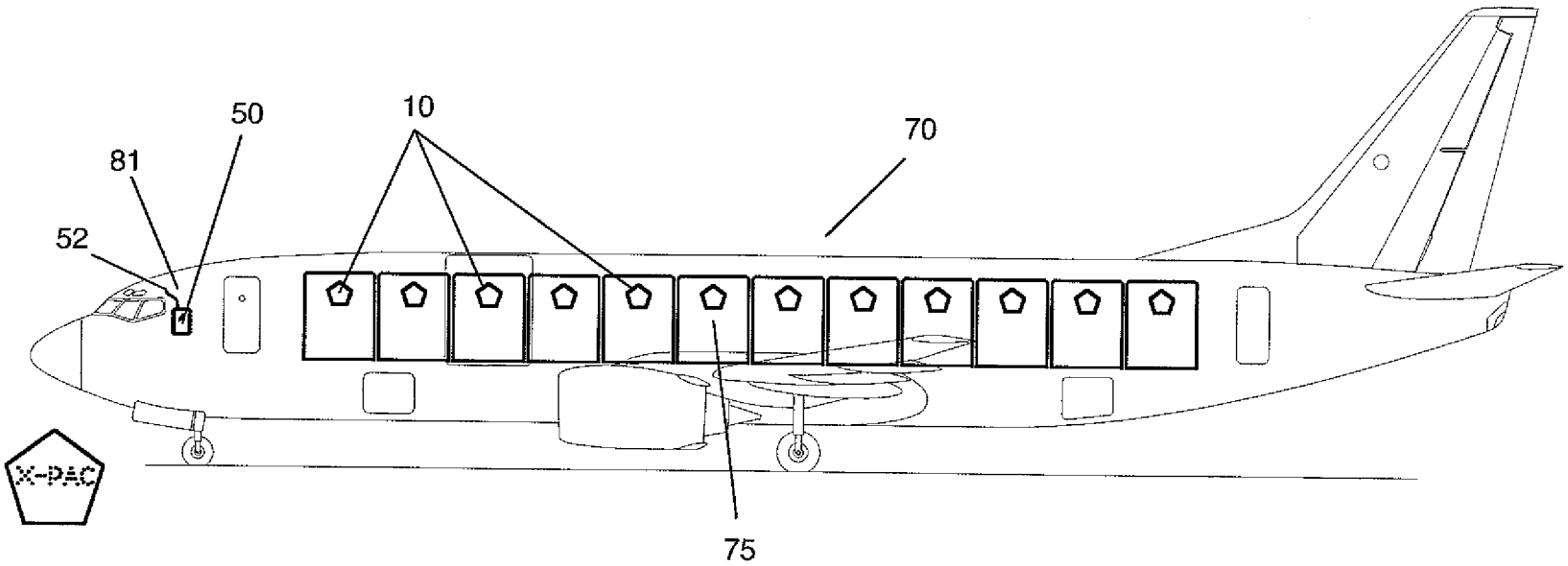
FIG. 7 shows a side view of the aircraft showing the location of cargo containers therewithin.

FIG. 7 shows the aircraft 70 with a multiplicity of cargo containers therein including the cargo container 75 also shown in FIGS. 5 and 6. The cockpit 81 of the aircraft contains the HMI 50 as shown. The HMI 50 includes an antenna 52 facilitating wireless communications with the units 10.

Figure 8A:
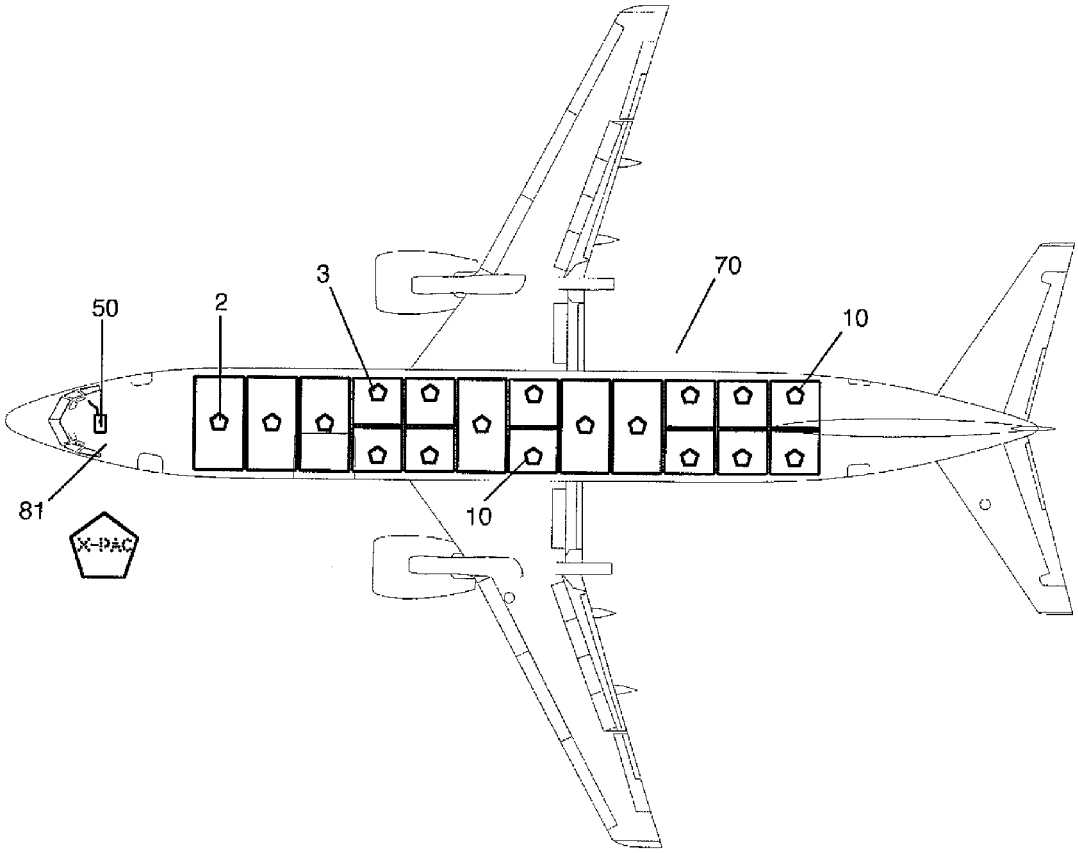
FIG. 8*a* shows a top view of the aircraft showing the positioning of cargo containers within the aircraft.

FIG. 8*a* shows the aircraft 70 from a top view showing a multiplicity of cargo containers in another configuration but with each including contained therein a fire suppression unit 10. The cockpit 81 is also shown and contains the HMI 50.

Figure 8B:
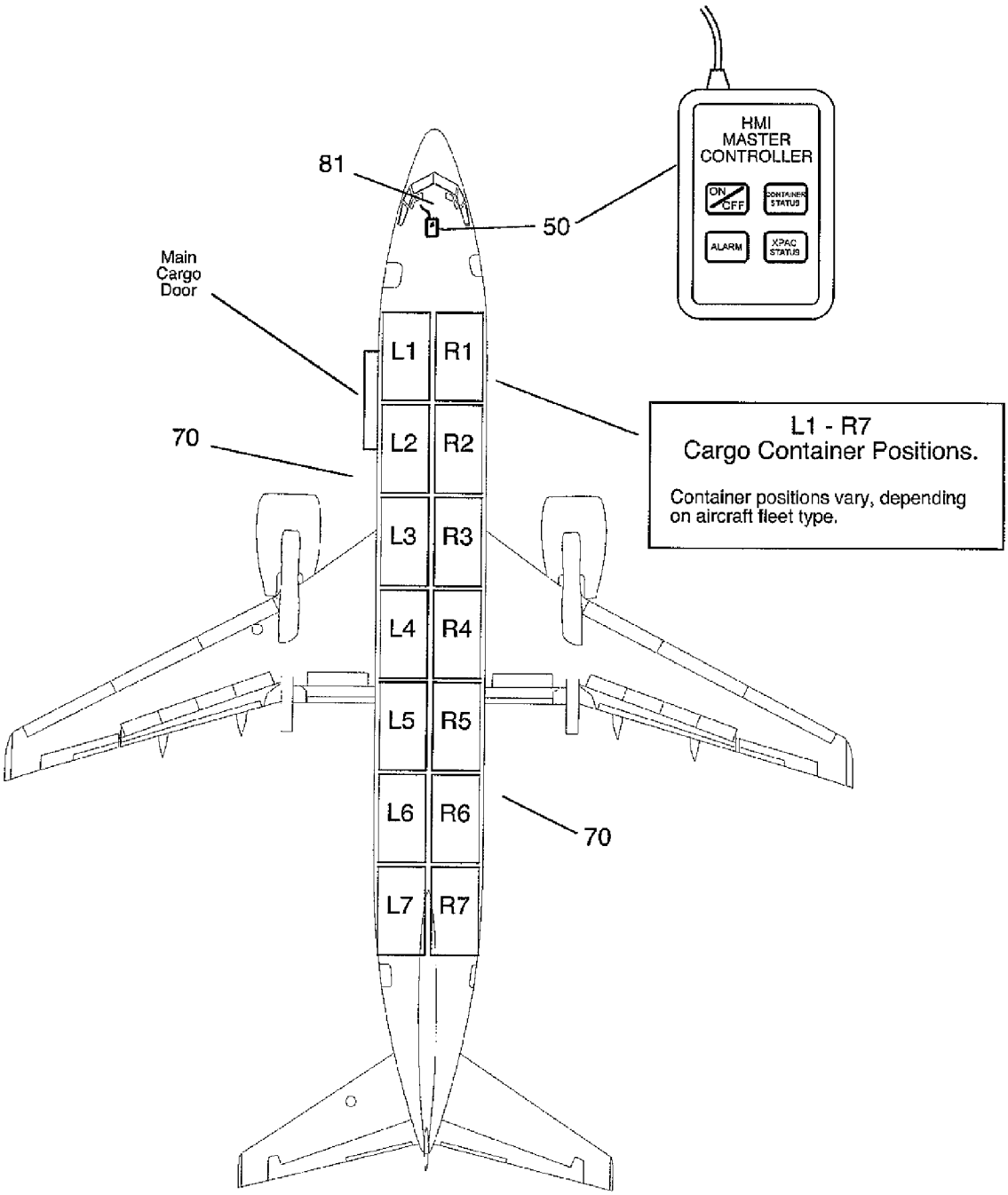
FIG. 8*b* shows a view similar to that of FIG. 8*a*, but showing further details of the relationship between the cargo containers and the HMI.

FIG. 8*b* shows the aircraft with a multiplicity of cargo container positions labeled L1 to R7. Each of these positions is designed to receive a cargo container such as those shown in FIGS. 7 and 8*a*. The cockpit 81 is shown containing the HMI 50.

Figure 4B:
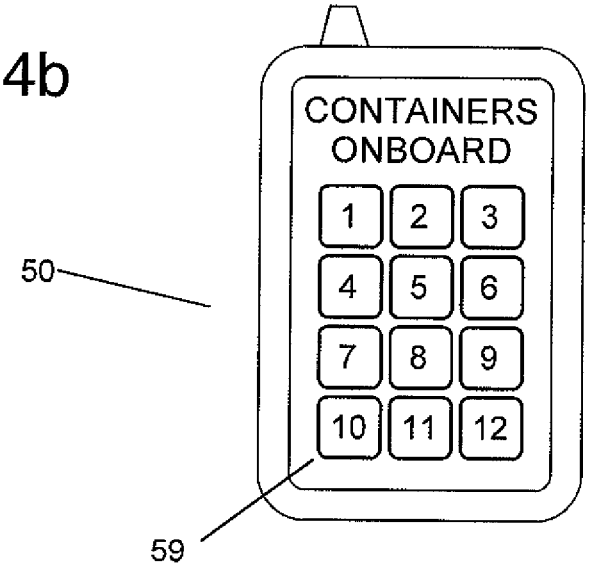
FIG. 4*b* shows a further view of the HMI showing buttons on a touch screen display allowing the user to access different ones of the fire suppression units.
Figure 4C:
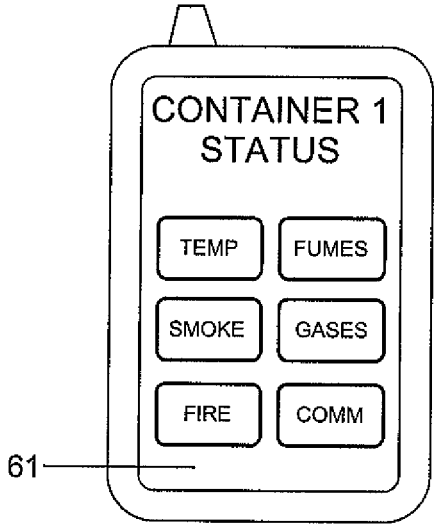
FIG. 4*c* shows a further screen view from the HMI allowing monitoring of conditions within a particular cargo container.
Figure 4D:
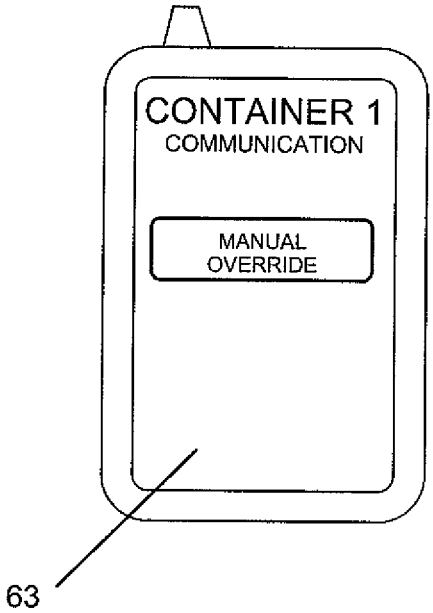
FIG. 4*d* shows a further screen shot of the HMI indicating the ability to override automatic systems contained within the fire suppression unit.
Figure 9:
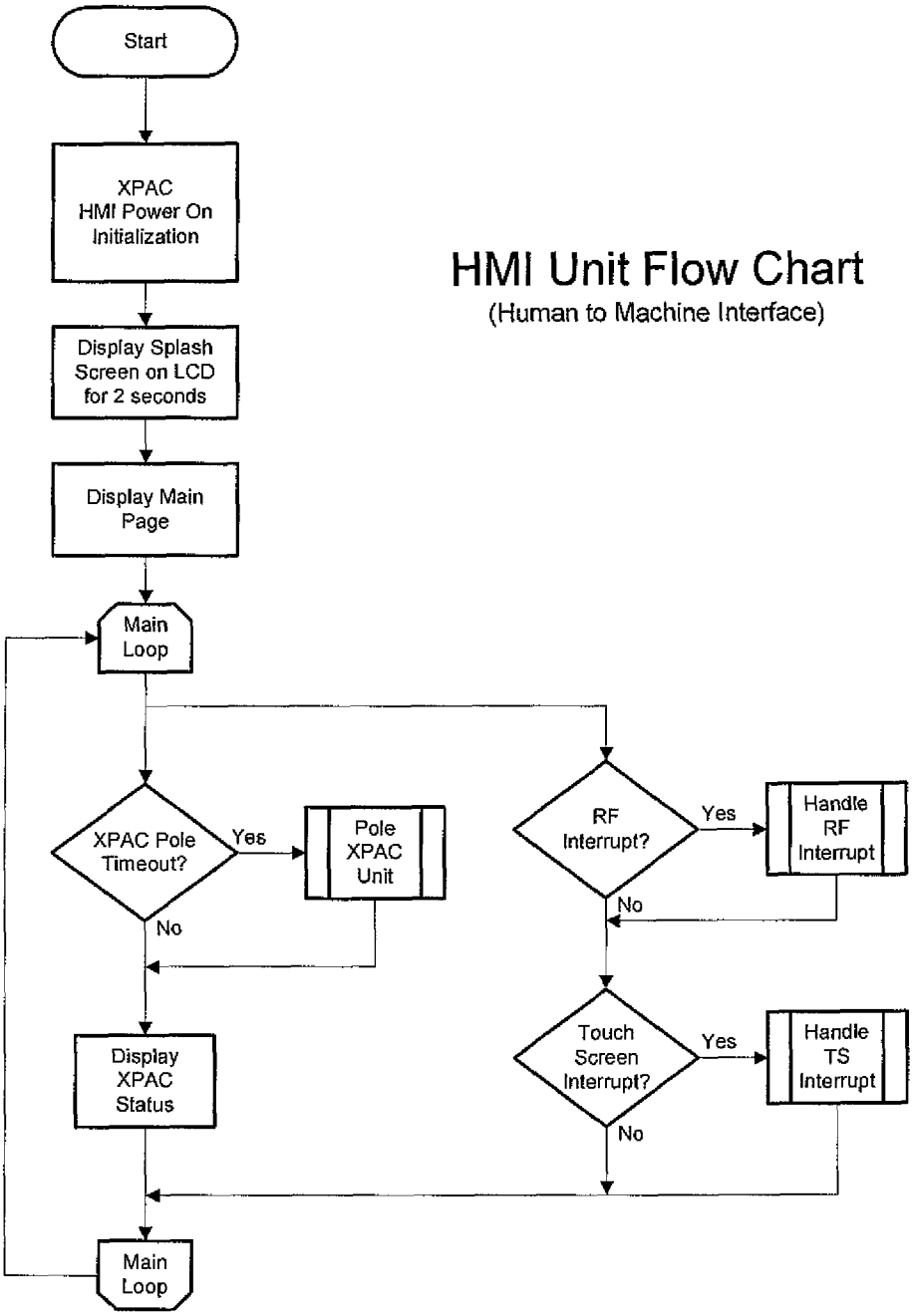
FIG. 9 shows an operational flowchart for the HMI.
Figure 10:
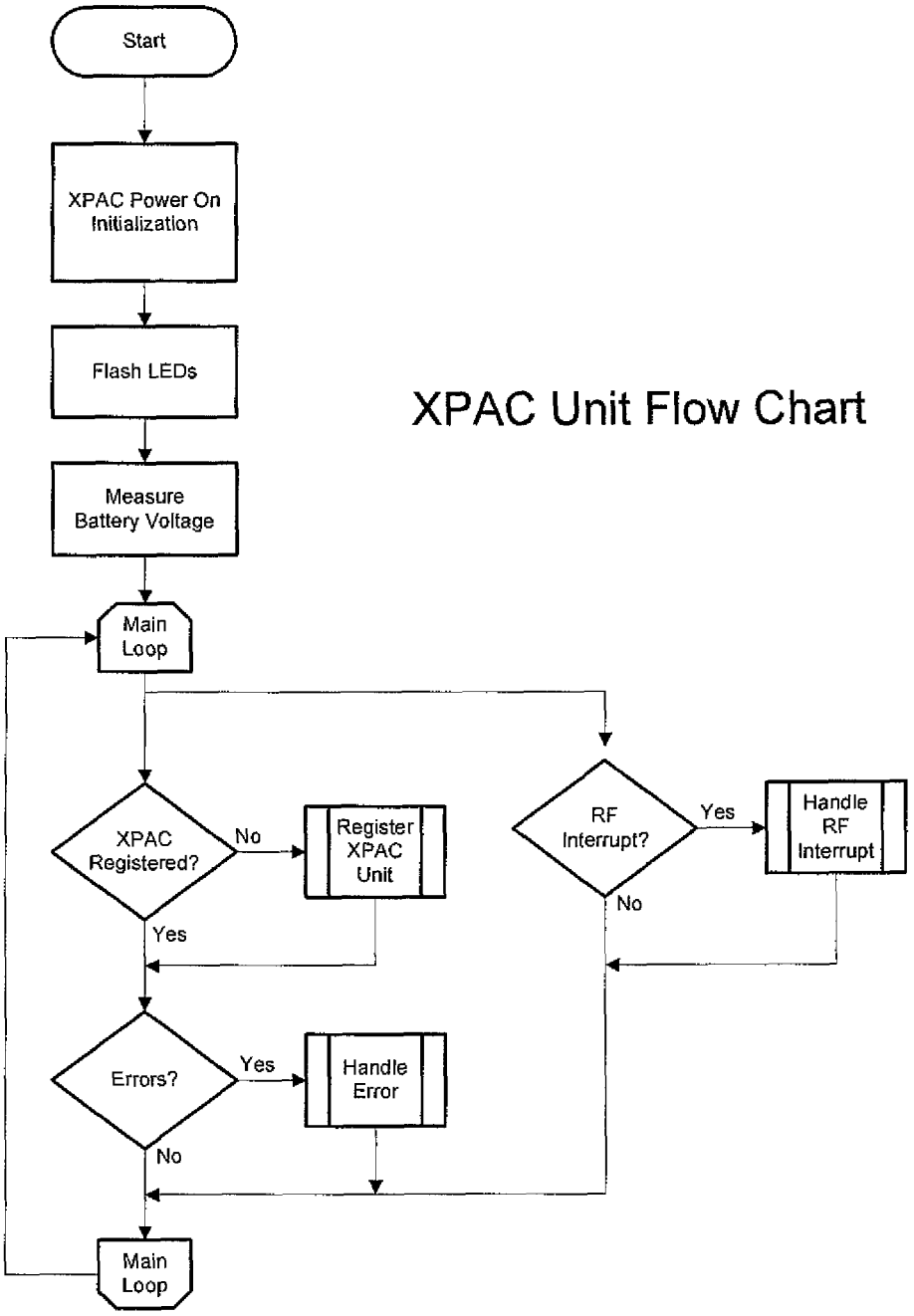
FIG. 10 shows an operational flowchart for a fire suppression unit.

FIG. 9 shows a flowchart for the operation of the HMI 50. The flowchart shows the manner of activation and operation of the HMI unit 50. FIG. 10 shows a flowchart of the operation of a fire suppression unit 10. It is important to note the aspect of this flowchart which shows the registration of the unit 10. This registration is accomplished by viewing the barcode 15 and correlating that barcode to the cargo container in which that particular fire suppression unit 10 is to be placed. When all of the cargo containers have been loaded into the aircraft, each containing a fire suppression unit 10 having a unique barcode, this correlated information is provided to the HMI 50 so that the buttons shown in FIG. 4*b* are specifically correlated so that the operator of the system, the pilot and/or crew, know which button corresponds to which cargo container.

With reference back to FIG. 1, the reference numeral 12 refers to an electrical receptacle which may receive a plug (not shown) connected to a charger to facilitate recharging the battery 37 (FIG. 3). That receptacle 12 may also receive a meter designed to facilitate measuring battery voltage to determine when the battery needs recharging. For example, a typical 12 volt battery is fully charged when it reads 12.8 volts DC and requires recharging when its measured voltage falls below 12.2 volts DC. The fire suppression unit 10 is designed with electrical components that draw only small amounts of current so that the unit 10 is operable for the length of time exceeding the longest usual airplane flight. The battery is designed to easily power the system for over 24 hours. The battery is also preferably made of components that are unlikely to cause a fire issue themselves.

The inventive system is easy to install, only requiring a power supply to the HMI 50. The fire suppression units 10 are completely portable and individually identifiable through their barcode labels 15. The HMI 50 and each fire suppression unit 10 includes self-contained transmitting and receiving capabilities so that all that is necessary in order to implement the system is to provide a multiplicity of fire suppression units 10, provide power to one HMI 50 and operate the system.

In operation, as baggage is being loaded into cargo containers, each cargo container is provided with its own fire suppression unit 10 preferably located at the upper reaches of the cargo container. Each cargo container may be specifically identified by any desired identifying information such as, for example, L1, R3, etc. as clearly shown in FIG. 8*b*. That information is correlated with the barcode for the individual fire suppression unit 10 located within the cargo container. Once all of this information is correlated and provided to the HMI 50, the system can efficiently, quickly, and reliably monitor conditions within each cargo container, provide that information at the cockpit of the aircraft, and facilitate safe, effective and quick fire suppression in the event of a fire condition. If desired, the bottle may contain sufficient chemicals to permit suppression of more than one fire in a single cargo compartment during a single flight.

As such, an invention has been disclosed in terms of a preferred embodiment thereof which fulfills each and every one of the objects of the invention as set forth hereinabove, and provides a new and useful fire suppression system for aircraft storage containers of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. In an aircraft having a cockpit, a baggage compartment, and a plurality of cargo containers, the improvement comprising a fire suppression system, comprising:

a) for each cargo container, a fire suppression unit removably placed within said cargo container, each said fire suppression unit comprising:

i) a housing having a front wall and a first side wall with at least one opening therethrough, and a second side wall extending non-orthogonally from said first side wall and having at least one opening therethrough;

ii) said housing including an inner chamber containing a fire extinguisher, a temperature sensor, a smoke detector, and a battery-powered controller and communications device, said fire extinguisher having a nozzle for expelling fire suppression chemicals, said nozzle being contained within said inner chamber;

iii) a valve controlling dispensing of fire suppression chemicals from said fire extinguisher;

iv) said temperature sensor communicating temperature readings to said controller;

v) said smoke detector communicating smoke concentration data to said controller;

vi) said controller communicating with a human to machine interface (HMI) via said communications device;

b) said HMI being located remote from said baggage compartment;

c) said controller receiving signals from said temperature sensor and smoke detector and, responsive thereto, controlling operation of said valve to dispense, when necessary, fire suppression chemicals from said fire extinguisher nozzle into said inner chamber and then, through at least one of said openings into said cargo container;

d) via said communications device, said controller communicating data received from said temperature sensor and smoke detector to said HMI and communicating information concerning activations of said valve.

2. The system of claim 1, wherein each fire suppression unit includes an identifier permitting a user to correlate it with a cargo container in which it is placed.

3. The system of claim 2, wherein said controller provides said HMI information correlating each fire suppression unit with a cargo container in which it is placed.

4. The system of claim 1, wherein said HMI communicates with each fire suppression unit wirelessly.

5. The system of claim 4, wherein said HMI and each fire suppression unit includes a transmitter-receiver permitting two-way wireless communications therebetween.

6. The system of claim 2, wherein said identifier comprises a barcode.

7. The system of claim 1, wherein said at least one opening in said first side comprises a multiplicity of openings.

8. The system of claim 1, wherein a said fire suppression unit is located at an upper portion of a cargo container in which it is placed.

9. The system of claim 1, wherein said housing is non-rectangular to lessen a possibility that said at least one hole of said first side and said at least one hole of said second side are both blocked by adjacent cargo.

10. The system of claim 9, wherein said housing is pentagonal.

11. The system of claim 1, wherein said HMI includes a display screen.

12. The system of claim 11, wherein said display screen is switchable between a plurality of displays including at least a first display permitting a user to choose to access data from a particular fire suppression unit and a second display displaying conditions sensed by said particular fire suppression unit.

13. The system of claim 12, further including a third display permitting activation and deactivation of said system.

14. The system of claim 11, wherein said display screen comprises a touch screen display.

15. The system of claim 13, wherein said display screen comprises a touch screen display.

16. In combination with an aircraft having a cockpit, a baggage compartment, and a plurality of cargo containers, a fire suppression system, comprising:

a) for each cargo container, a fire suppression unit removably placed within said cargo container, each said fire suppression unit comprising:

i) a housing having a front wall and a first wall with a plurality of openings therethrough, and a second wall non-orthogonal with said first wall and having a plurality of openings therethrough;

ii) an inner chamber containing a fire extinguisher, a temperature sensor, a smoke detector, and a battery-powered controller and communications device, said fire extinguisher having a nozzle for expelling fire suppression chemicals, said nozzle being contained within said inner chamber;

iii) a valve controlling dispensing of fire suppression chemicals from said fire extinguisher;

iv) said temperature sensor communicating temperature readings to said controller;

v) said smoke detector communicating smoke concentration data to said controller;

vi) said controller wirelessly communicating with a human to machine interface (HMI) via said communications device;

b) said HMI being located remote from said baggage compartment in said cockpit;

c) said controller receiving signals from said temperature sensor and smoke detector and, responsive thereto, controlling operation of said valve to dispense, when necessary, fire suppression chemicals from said fire extinguisher nozzle into said inner chamber and then, through said openings and into said cargo container;

d) said controller communicating data received from said temperature sensor and smoke detector, sensing conditions in said container through said openings, to said HMI via said communications device, and communicating information concerning activations of said valve.

17. The system of claim 16, wherein each fire suppression unit includes an identifier permitting a user to correlate it with a cargo container in which it is placed, said identifier comprising a barcode, said controller providing said HMI information correlating each fire suppression unit with a cargo container in which it is placed.

18. The system of claim 16, wherein said HMI and each fire suppression unit includes a transmitter-receiver permitting two-way wireless communications therebetween.

19. The system of claim 16, wherein said housing is pentagonal in shape to lessen a possibility that said openings are blocked by adjacent cargo.

20. The system of claim 16, wherein said HMI includes a touch screen display screen switchable between a plurality of displays including at least a first display permitting a user to choose to access data from a particular fire suppression unit and a second display displaying conditions sensed by said particular fire suppression unit.

* * * * *